United States Patent [19]

Collins

[11] Patent Number: 4,464,001

[45] Date of Patent: Aug. 7, 1984

[54] COUPLING NUT HAVING AN ANTI-DECOUPLING DEVICE

[75] Inventor: Gordon T. Collins, Sidney, N.Y.

[73] Assignee: The Bendix Corporation, Southfield, Mich.

[21] Appl. No.: 430,905

[22] Filed: Sep. 30, 1982

[51] Int. Cl.[3] ..... H01R 13/625

[52] U.S. Cl. ..... 339/90 R; 339/DIG. 2

[58] Field of Search ..... 339/90 R, 90 C, DIG. 2, 339/88 R, 181, 188, 189, 190; 285/396; 403/349

[56] References Cited

U.S. PATENT DOCUMENTS

| | | | |
|---|---|---|---|
| 1,514,314 | 11/1924 | Douglas | 339/188 R |
| 3,778,747 | 12/1973 | Curcic | 339/90 R |
| 4,072,385 | 2/1978 | Wallner | 339/88 R |
| 4,235,498 | 11/1980 | Snyder | 339/90 R |
| 4,359,256 | 11/1982 | Gallusser et al. | 339/90 R |

FOREIGN PATENT DOCUMENTS

| | | | |
|---|---|---|---|
| 1389857 | 1/1965 | France | 339/90 C |

*Primary Examiner*—John McQuade

*Attorney, Agent, or Firm*—C. D. Lacina

[57] ABSTRACT

An electrical connector assembly including a pair of mating shells (100, 200) having end faces (122, 224) on dielectric inserts (110, 210) and a coupling nut (300) rotatably mounted on first shell (100), coupling nut (300) including an elongated a generally U-shaped passageway (142, 146, 144) sized to receive a coupling pin (280) on second shell (200), the passageway forming an integral cantilevered latch spring (160) of the type having adjacent its deflectable end a detent (162) for captivating the pin (280), rotation of coupling nut (300) bringing end faces (122, 224) into abutment to stop axial advance but permit continued rotation to allow coupling pin (280) to advance along the passageway to deflect latch spring (162) downwardly and reach the detent (162) whereupon latch spring (162) springs forwardly to captivate coupling pin (280) therein.

9 Claims, 4 Drawing Figures

FIG. 2
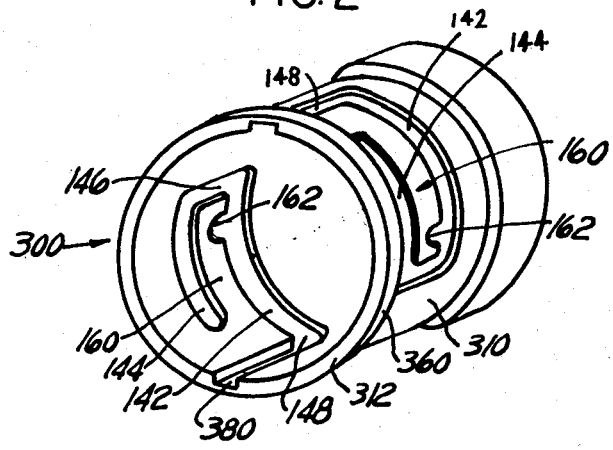
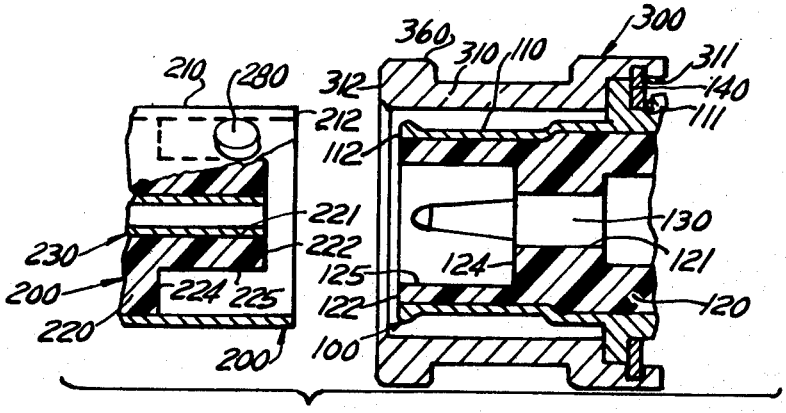
FIG. 1
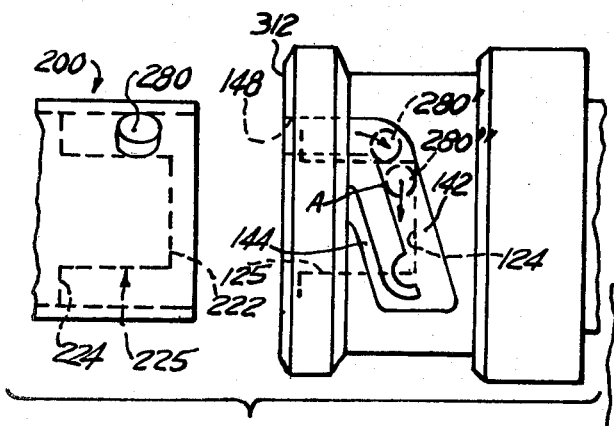
FIG. 3
FIG. 4
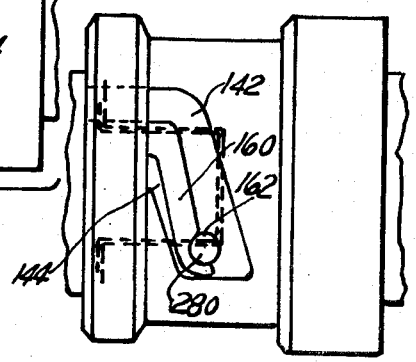

COUPLING NUT HAVING AN ANTI-DECOUPLING DEVICE

This invention relates to an electrical connector assembly having an anti-decoupling device and more particularly to a coupling nut including an integral spring element in a bayonet-type coupling arrangement.

An electrical connector assembly generally comprises two separate cylindrical connector housings adapted to be connected together by a coupling member rotatably mounted on one of the connector housings. In a typical bayonet-type coupling arrangement, the coupling member includes a helical slot terminating in a detent sized to receive a pin extending radially from the other connector housing whereby when the coupling member is rotated and the pin advanced relative to the slot, the housing members ae axially drawn together and the pin received in the detent. A separate spring element is ordinarily utilized to captivate the pin to preventing unwanted uncoupling of the connector housings. In "Electrical Connector" U.S. Pat. No. 2,984,811 issuing May 16, 1981 to Hennessey, Jr. et al, a sinusoidal wave washer is retained between the coupling member and the one housing so as to provide a constant rearward bias on the coupling member. The washer bias retards uncoupling of the conector housings by increasing frictional forces which the pin must overcome to escape from its detent. Wave washers can fatigue in time since the bias must be maintained continuously. In "Electrical Connector With Locking Means" U.S. Pat. No. 4,235,498 issuing Nov. 25, 1980 to Snyder, the bayonet pin progressively engages a linear succession of detent peaks-and-valleys disposed on a separate plastic spring retained near the end of the slot. While these arrangements are commonly used and have found acceptable by those in the electrical connector industry, elimination of separate spring parts from the assembly without compromising coupling retention would be desirable.

This invention eliminates need for a separate spring constantly biasing a coupling member relative to an electrical connector assembly having an anti-decoupling device, the assembly comprising: a pair of coaxial shells having interfittable forward portions and dielectric inserts retaining electrical contacts with the forward portion of one shell including a coupling pin; a coupling nut including an end face and a longitudinal guideway therein for receiving the coupling pin, the coupling nut being rotatably disposed about the other shell for connecting the shells with respect to the one another to cause mating engagement of the respective electrical contacts mounted therein; and an anti-decoupling device for preventing unwanted disconnection between the coupling portions. In accord with this invention, the anti-decoupling device comprises respective end faces associated with the dielectric inserts abutting for limiting axial movement of the coupling pin in the guideway and a longitudinally deflectable, cantilever latch spring having a detent thereon for securing the pin, the latch spring being integrally formed in the coupling nut wall and defined by a U-shaped passageway comprising first and second laterally extending slots joined at one of their ends by a bight with the first slot being further rearward of the end face than the second slot and being joined at its other end to the guideway for receiving the pin, advancing and rotating the coupling nut causing the end faces to abut and limit axial movement between the shells but allowing the pin to rotate into engagement with the latch spring to deflect the latch spring until the pin reaches the detent whereupon the latch springs forward and captivates the pin.

One advantage of this invention is provision of a coupling nut including a resiliently deflectable latch spring within the bayonet-type ramp to secure a pin. Another advantage of this invention is provision of a coupling member including in its wall an integrally formed latch spring. Yet another advantage of this invention is a simple bayonet-type coupling which may be engaged in less than one turn. Finally, an advantage of the invention is provision of a latch spring which eliminates need for a wave washer to provide a constant rearward bias on the coupling member of a coupling assembly.

One way of carrying out the invention is described in detail below with reference to the drawings which illustrate one specific embodiment of this invention, in which:

FIG. 1 is a partial side view in section of a pair of electrical connectors and a coupling nut utilizing the principles of this invention.

FIG. 2 is a detailed view of the coupling nut according to this invention.

FIG. 3 shows assembly of the electrical connectors of FIG. 1.

FIG. 4 shows the completed electrical assembly.

Referring now to the drawings, FIG. 1 shows an electrical connector assembly of the type including a pair of shells 100, 200 and a coupling nut 300 mounted to one shell for connecting to the other shell, the shells and coupling nut being coaxially disposed for mating along a center axis. Each of the shells 100, 200 have, respectively, interfittable forward portions 110, 210 having front end faces 112, 212 with forward portion 210 including a coupling pin 280 extending radially outwardly therefrom and a dielectric insert 120, 220 having a passage 121, 221 retaining an electrical 130, 230 for mating, first shell 100 including a stepped groove 111 therearound for receiving a retaining ring 140. As shown, electrical contact 130 mounted in dielectric insert 110 is a plug-type and electrical contact 230 mounted in dielectric insert 210 is a rocket-type. Each of the contacts could be other than shown.

Each of the dielectric inserts 120, 220 include, respectively, longitudinally spaced, forward and rearward end faces 122, 222; 124, 224 with dielectric insert 220 having a cylindrical wall 225 defining a male-type portion between its end faces 222, 224 and dielectric insert 120 having a cylindrical wall 125 defining a receptacle portion (or recess) between its end faces 122, 124, the male-portion being sized to clearance fit the cylindrical recess.

Preferably and in accord with this invention forward end face 222 of insert 220 and rearward end face 124 of insert 120 define limits of axial travel for the respective shells 100, 200. Further and in accord with this invention, forward and rearward end faces 122, 224 of the first and second dielectric inserts 120, 220, respectively, would also abut one another when the connectors are mated and limit forward axial advance of the respective shells.

The coupling nut 300 includes a tubular forward coupling portion 310 having a support rim 360 around an end face 312 thereof, the coupling nut being rotatably disposed about first shell 100 for connecting the shell forward portions 110, 210 together, rotation of the coupling nut axially advancing first shell 100 with respect to second shell 200 to cause rearward end face 124 associated with dielectric insert 120 mounted within first shell 100 to abut forward end face 222 associated with dielectric insert 220 mounted in second shell 200 and to cause mating engagement for the respective electrical contacts 130, 230. Coupling nut 300 includes an annular groove 311 and is rotably captivated to first shell 100 by a retaining ring 140 being received, respectively, in annular grooves 311, 111.

FIG. 2 shows coupling nut 300 including an integral spring device for preventing unwanted disconnection between the connector shells. Preferably and in accord with this invention, coupling nut 300 includes in its forward coupling portion 310 a longitudinally deflectable latch spring 160 having a detent 162 disposed at a remote end thereof for securing coupling pin 280 extending radially from forward portion 210 of second shell 200. Latch spring 160 is defined by a continuous U-shaped passageway comprising first and second laterally extending slots 142, 144 being joined at one of their ends by a longitudinal slot 146 with the first slot 142 being joined at its other end to guideway 148 extending longitudinally rearwardly from a key 380 disposed in end face 312 of the coupling nut, the guideway 148 and first slot 142 being adapted to receive coupling pin 280 with the first lateral slot 142 being further rearward from end face 312 than the second lateral slot 144. As such, latch spring 160 defines an integral cantilever-type beam. Preferably, two equiangularily disposed latch springs 160 are provided in the wall of the coupling nut.

FIG. 3 shows first and second shells 100, 200 aligned for mating into an electrical connector assembly with coupling nut 300 being rotably mounted to first connector shell 100. The coupling pin 280 on second shell 200 is aligned with the longitudinally extending guideway 148 on the coupling nut. Also and shown in phantom are rearward and forward end faces 124, 122; 244, 222 of the respective dielectric inserts 110, 120 mounted in the respective electrical connector shells 100, 200.

As a result of advancing and rotating coupling nut 300, coupling pin 280 advances longitudinally into guideway 148 and then laterally rearwardly into first lateral slot 142 until such time as rearward end face 124 in first connector shell 100 abuts forward end face 222 in second connector shell 200, the abutting faces prohibiting further axial movement between the shells but not denying rotational movement of the coupling nut. The arrows associated with numbers 280' and 280'' (shown in phantom) show successive positions of coupling pin 280. Further rotation of coupling nut 300 causes pin 280 to abut against the latch spring 160 at an intermediate contact point "A" of the latch spring with further rotation camming the coupling pin along the edge of the latch spring to deflect the latch spring longitudinally forwardly towards end face 312 of the coupling nut. Ultimately after this additional rotation, which is much less than one complete rotation, coupling pin 280 reaches detent 162 and the spring latch springs forwardly to captivate the pin in the detent.

FIG. 4 shows a coupled relation wherein latch spring 160 is longitudinally biasing detent 162 against coupling pin 280.

While a preferred embodiment of the invention has been disclosed, it will be apparent to those skilled in the art that changes may be made to the invention as set forth in the appended claims and, in some instances, certain features of the invention may be used to advantage without corresponding use of other features. For example, a pair of equiangularly disposed coupling pin/spring latches may be provided. Further, although coupling nut 300 is shown as having a support rim 360 around end face 312 thereof providing a polarizing (i.e., orientation) means, support rim itself is not necessary for the principles recited herein of removing a passageway from the wall of the coupling nut to form a cantilever latch spring integrally therewith. Accordingly, it is intended that the illustrative and descriptive materials herein be used to illustrate the principles of the invention and not limit the scope thereof.

I claim:

1. An electrical connector assembly having an anti-decoupling device comprising: first and second shells (100, 200) with each including, respectively, a dielectric insert (120, 220) and said second shell (200) further including a radially extending coupling pin (280) on an outside portion thereof; a coupling nut (300) rotatably disposed about said first shell (100) and including a longitudinal guideway (148) for receiving the coupling pin (280); and an anti-decoupling device for preventing unwanted disconnection between the shells, said anti-decoupling device characterized by a first end face (124) associated with said first shell (100) being adapted to abut a second end face (222) associated with said second shell (200) for limiting axial advance of the shells but allowing continued rotation of the coupling nut; said coupling nut (300) including a slot arrangement for receiving the coupling pin and including a longitudinal slot (146) and first and second laterally extending slots (142, 144) joined at their adjacent ends by the longitudinal slot (146), said first lateral slot (142) being joined at its other end to the guideway (148), said slot arrangement forming integrally of the coupling nut (300) a deflectable latch spring (160) including a detent (162) formed thereon for receiving and securing said coupling pin (280), longitudinally advancing the coupling nut (300) causing the end faces (124, 222) to abut and the coupling pin (280) to be presented into the first lateral slot (142) and against the latch spring (160), rotating the coupling nut driving the coupling pin against the latch spring and the latch spring to deflect rearward whereby the coupling pin advances to the detent, whereupon the latch spring deflects forward and the detent captivates the coupling pin.

2. The electrical connector assembly as recited in claim 1, wherein said end faces (122, 224) are disposed on dielectric inserts (120, 220).

3. The electrical connector assembly as recited in claim 2, wherein said dielectric insert (220) includes a second end face (224) and a generally cylindrical male-portion (225) extending between the end faces (222, 224), and said dielectric insert (120) includes a second end face (122) and a generally cylindrical receptacle (125) extending between said end faces (122, 124), said receptacle (125) being sized to receive said male-portion (225).

4. The electrical connector assembly as recited in claim 3, wherein the first and second end faces (122, 124) of said dielectric insert (120) abut, respectively , the first and second end faces (222, 224) of said dielectric insert (220) for limiting axial entry of said male-portion (225) into the receptacle (125).

5. The electrical connector assembly as recited in claim 2, wherein a pair of deflectable latch springs (160)

are equiangularly disposed on said coupling portion (310).

6. An electrical connector coupling member for connecting together two electrical connector shells (100, 200), said coupling member including a tubular wall having a front face and being adapted to mount for rotation to one of said shells (100) and connect to a coupling pin (280) extending radially from the other of said shells (200), the coupling member being characterized by: a guideway (140) extending longitudinally rearward from the front face for receiving the coupling pin (280), and a continuous U-shaped passageway (142, 144, 146) formed into the wall to define an integral cantilever-type latch spring (160), said latch spring having a secured end portion thereof forming part of the guideway (140), a free end portion thereof being longitudinally deflectable, and means (162) disposed at the free end portion thereof for captivating the coupling pin (280), said U-shaped passageway comprising generally laterally extending first and second slots (142, 144) with the first slot (142) communicating with said guideway (140) to provide a continuous rearward path from the front face for the coupling pin (280) to follow to reach said captivating means.

7. The electrical connector coupling member as recited in claim 6, wherein the captivating means (162) at the free end portion of the latch spring (160) comprises a detent (162).

8. The electrical connector coupling member as recited in claims 6 or 7, wherein the U-shaped passageway (142, 144, 146) comprises said first slot (142) defining an edge of latch spring (160) for engaging said coupling pin (280) and the second lateral slot (144) defining a space wherein the latch spring may longitudinally deflect.

9. The electrical connector coupling member as recited in claim 6, wherein the first lateral slot (142) is substantially linear.

* * * * *